US009051072B2

(12) United States Patent
Eder et al.

(10) Patent No.: US 9,051,072 B2
(45) Date of Patent: Jun. 9, 2015

(54) LABELING SYSTEM

(75) Inventors: Erich Eder, Donaustauf (DE); Roland Ederer, Woerth/Donau (DE); Dieter Hafner, Regensburg (DE)

(73) Assignee: KRONES, AG, Neutraubling (DE)

( * ) Notice: Subject to any disclaimer, the term of this patent is extended or adjusted under 35 U.S.C. 154(b) by 1236 days.

(21) Appl. No.: 12/440,689

(22) PCT Filed: Sep. 5, 2007

(86) PCT No.: PCT/EP2007/007737
§ 371 (c)(1),
(2), (4) Date: Nov. 5, 2009

(87) PCT Pub. No.: WO2008/031521
PCT Pub. Date: Mar. 20, 2008

(65) Prior Publication Data

US 2010/0051179 A1 Mar. 4, 2010

(30) Foreign Application Priority Data

Sep. 11, 2006 (DE) ..... 10 2006 043 260

(51) Int. Cl.
*B65H 69/06* (2006.01)
*G03D 15/04* (2006.01)
*B65C 9/10* (2006.01)

(52) U.S. Cl.
CPC ..... *B65C 9/105* (2013.01); *Y10T 156/17* (2015.01); *Y10T 156/12* (2015.01)

(58) Field of Classification Search
CPC ..... B32B 37/00; B32B 37/025; B21D 43/00; B29C 31/00; B29C 31/004; B65B 35/00
See application file for complete search history.

(56) References Cited

U.S. PATENT DOCUMENTS 3,733,230 A * 5/1973 Prittie ..... 156/64
4,555,281 A * 11/1985 Mattei et al. ..... 156/64
4,655,865 A * 4/1987 Nozaka ..... 156/157

(Continued)

FOREIGN PATENT DOCUMENTS

DE 3702595 A1 8/1988
DE 19818384 A1 10/1999

(Continued)

OTHER PUBLICATIONS

International Search Report for PCT Application No. PCT/EP2007/007737, dated Dec. 5, 2007.

(Continued)

*Primary Examiner* — Mark A Osele
*Assistant Examiner* — Nickolas Harm
(74) *Attorney, Agent, or Firm* — Onello & Mello, LLP.

(57) ABSTRACT

A labeling system may include a labeling device which applies labels to objects, for example, containers, and a loading device which is arranged upstream of this labeling device and which supplies the labeling device with labels The loading device may comprise a transport device which transports a second label strip and comprises at least two carriers for first label strips wound onto label rolls The carriers may be arranged next to one another on holding devices. A joining unit may be provided which can be displaced between the carriers in a first movement direction and which joins sections of the first label strips, which are arranged on the carriers, to sections of the second label strips, which are guided in the transport device.

20 Claims, 2 Drawing Sheets

(56) References Cited

U.S. PATENT DOCUMENTS

| | | | | |
|---|---|---|---|---|
| 5,053,096 | A * | 10/1991 | Long et al. | 156/157 |
| 5,152,858 | A * | 10/1992 | Winter | 156/157 |
| 5,190,234 | A * | 3/1993 | Ezekiel | 242/552 |
| 5,296,076 | A * | 3/1994 | Morita | 156/361 |
| 5,427,639 | A * | 6/1995 | Minarelli | 156/157 |
| 6,051,095 | A * | 4/2000 | Butterworth | 156/285 |
| 6,814,123 | B2 * | 11/2004 | Erickson | 156/450 |
| 7,128,795 | B2 * | 10/2006 | Byrne et al. | 156/159 |
| 2001/0018953 | A1 * | 9/2001 | Gnan et al. | 156/504 |
| 2002/0189746 | A1 * | 12/2002 | Kuta et al. | 156/157 |
| 2003/0116256 | A1 * | 6/2003 | Erickson | 156/157 |
| 2003/0121593 | A1 | 7/2003 | Monroe | |
| 2008/0135158 | A1 * | 6/2008 | Baumli | 156/157 |

FOREIGN PATENT DOCUMENTS

| | | | |
|---|---|---|---|
| DE | 10105748 | A1 | 8/2002 |
| DE | 20219876 | U1 | 7/2003 |
| JP | 2000-118517 | A | 4/2000 |
| WO | 2005110859 | A | 11/2005 |

OTHER PUBLICATIONS

Translation of Japanese Office Action dated May 12, 2012, issued in corresponding Japanese Patent Application No. 2009-527726.

* cited by examiner

LABELING SYSTEM

CROSS-REFERENCE TO RELATED APPLICATION

This application is filed under 35 U.S.C. 371 as a U.S. national phase application of PCT/EP2007/007737, having an international filing date of Sep. 5, 2007, which claims the benefit of German Patent Application No. 10 2006 043 260.6 having a filing date of Sep. 11, 2006, the contents of which are hereby incorporated by reference in their entirety.

TECHNICAL FIELD

The present invention relates to a labelling system and will be described with reference to a labelling system for labelling containers. However, it is pointed out that the labelling system according to the invention can also be used for labelling other objects. Various labelling systems are known from the prior art. In these, a labelling device is provided which applies the labels to the containers.

BACKGROUND

The labels can be provided in various ways, for example as endless label strips for winding around containers, as self-adhesive label strips, etc. The endless label strips are cut only as necessary at the respective marks, are wound around the containers and glued.

Usually, endless label strips are wound onto label rolls which run out during the labelling process. After the complete unwinding of such a label roll, a further label roll is inserted and the process is continued. However, this leads to delays when an empty label roll has to be replaced by a full label roll.

It may therefore be desirable to provide a labelling system which allows a smoother running of the process even when replacing the label rolls. According to various aspects of the disclosure, a labelling system, a loading device for a labelling system, and a method for joining label strips may provide a smoother labeling process.

SUMMARY OF THE INVENTION

The labelling system according to the invention comprises a labelling device which applies labels to objects and in particular to containers. Also provided is a loading device which is arranged upstream of this labelling device and which supplies the labelling device with labels, wherein this loading device comprises a transport device which transports a second label strip and comprises at least two carriers for label strips wound onto label rolls, said carriers being arranged next to one another on holding devices. According to the invention, a joining unit is provided which can be displaced between the carriers in a first movement direction and which joins sections of the first label strips, which are arranged on the carriers, to sections of the second label strips, which are guided in the transport device.

The loading device is in particular a magazine in which a plurality of label rolls are arranged, so that the labelling device can be supplied with the label strips of these individual label rolls one after the other. Preferably, the transport device is connected to the joining unit and is displaced together with the latter. The transport device thus in particular forms part of the joining unit.

It is also possible in this way to achieve an essentially continuous operation of the labelling device. In the method, firstly the label strip of the first label roll passes via the transport device and optionally a buffer device to the labelling device. Once the first label roll has been used up, an end section of the first label roll is joined to a start section of the second label roll, which is arranged on a second carrier, and then the label strip of the second label roll is conveyed via the transport device to the labelling device. The procedure carries on in the same way with further label rolls. There is thus also sufficient time to replace empty label rolls with completely or partially full label rolls. The buffer device means that the labelling device need not be stopped during the joining process. The buffer device may comprise for example a plurality of deflection rolls around which the label strip is guided, it being possible for some of the deflection rolls to be displaced relative to one another.

In one preferred embodiment, the transport device, which comprises a drive unit, moves the label strips at least partially exclusively in a second movement direction, wherein the first movement direction and the second movement direction are essentially perpendicular to one another. In other words, the label strips which are unwound from the label rolls are guided in a direction which runs for example at a tangent to the label rolls. The joining unit is moved in a direction essentially perpendicular thereto. However, it is also possible that the first movement direction and the second movement direction are arranged at an angle other than 90°, for example at 45°.

In a further preferred embodiment, each carrier is assigned a stationary fixing device which at least temporarily fixes an end section of the first label strips. Here, stationary is understood in particular to mean stationary relative to the surroundings. Preferably, the fixing device is attached to a common frame which also bears the carriers and/or the holding devices thereof. With particular preference, said fixing device is a vacuum suction strip. By means of this suction strip, the end sections belonging to the individual label rolls arranged on the holding devices are in each case temporarily fixed in order to be joined to the respective other end sections of the label strip in the transport device.

In a further advantageous embodiment, the joining unit has a second fixing device which at least temporarily fixes an end section of the label strips. Here, this second fixing device serves in particular to fix the respective second end sections located at the end of that label strip which runs in the transport device. In the advantageous embodiment mentioned here, this second fixing device can move together with the joining unit in the first movement direction, and the fixing device can move separately for example in the form of a stamp in a direction perpendicular thereto in order to press the two end sections against one another and in this way join them together, for example through the use of adhesive/a strip of adhesive.

The second fixing device can thus move only in the first movement direction and in a movement direction perpendicular thereto, but not in the second movement direction. Fixing devices which can also move in the second movement direction, that is to say the movement direction in which label strips are moved relative to the joining unit, are known from the prior art. By virtue of the advantageous design which does not allow any movement in this second movement direction, a higher stability and accuracy of the fixing process is achieved.

With particular advantage, each carrier is driven by a servo motor. The individual carriers and thus the label rolls arranged on these carriers are thus driven in each case by separate servo motors, so that an actuation at different speeds is also possible. With particular advantage, the drive speed of the individual servo motors is controllable.

In a further advantageous embodiment, at least one carrier is arranged on a displaceable holding device. The holding device is displaceable in particular in the second movement direction. This displaceability serves for pulling the carriers out of the frame and replacing one label roll for example with another label roll.

In a further advantageous embodiment, at least one fullness measuring device is provided which checks a fullness state of a label roll. It is possible to check the fullness state optically. However, it is also possible to check the fullness state indirectly via the rotational speed of the label roll. This will be explained in more detail with reference to the figures.

In a further preferred embodiment, a plurality of deflection rollers are provided between the carriers and the joining device, wherein at least two deflection rollers can move in translation relative to one another. One of these deflection rollers is thus preferably a dancer roller. From a movement of this dancer roller, it is possible to deduce a fullness state of a respective label roll, which will likewise be explained in more detail with reference to the figures. Preferably, one deflection roller is pre-stressed with respect to the others for example by means of a spring.

In a further preferred embodiment, a cutting device is provided for cutting the label strips. It is thus possible for example for undesired end sections or leftovers to be cut off or for a straight cut of the label strips to be obtained. Preferably, the cutting device is also displaceable in the first movement direction.

The present invention also relates to a loading device for a labelling system, wherein this loading device comprises a transport device which transports a label strip, and also at least two carriers for label strips wound onto label rolls, said carriers being arranged on holding devices arranged next to one another. Also provided is a joining unit which joins (end) sections of the label strips which are arranged on the carriers to an end section of the label strip which is guided in the transport device. The loading device has a drive device which transports the label strips in just one second movement direction relative to the joining unit.

According to the invention, the joining unit can be displaced in just one first movement direction and this first movement direction is at a fixedly predefined angle and preferably essentially perpendicular to the second movement direction.

The joining unit preferably has a fixing device, and the latter can move only in the first movement direction (together with the joining unit) and in a direction perpendicular to the first and the second movement direction. This last-mentioned movement direction is the direction of the stamping movement of the fixing device.

Preferably, the loading device is configured in the manner described above.

The present invention also relates to a method for joining end sections of label strips by means of a loading device, wherein this method comprises the following steps: In a first step, a first end section of a first label strip is joined to a second end section of a second label strip arranged in a transport device, wherein the joining takes place by means of a joining unit. Furthermore, the first label strip is unwound from a first label roll and is guided through the transport device. In a further method step, a second end section of the first label strip is joined to a first end section of a further first label strip, wherein the joining takes place by means of the joining unit, the joining unit is moved between the first label roll and the second label roll in a first movement direction, and the label strip is moved in the second movement direction relative to the joining unit.

According to the invention, during the process of joining the two end sections, at least one end section is fixed relative to the joining unit and the joining unit is moved exclusively in a direction which is perpendicular to the first movement direction and the second movement direction. This movement is thus a stamping, lifting and/or pressing movement which presses the two end sections against one another. Further advantages and embodiments will emerge from the appended drawings:

DETAILED DESCRIPTION

Figure 1:
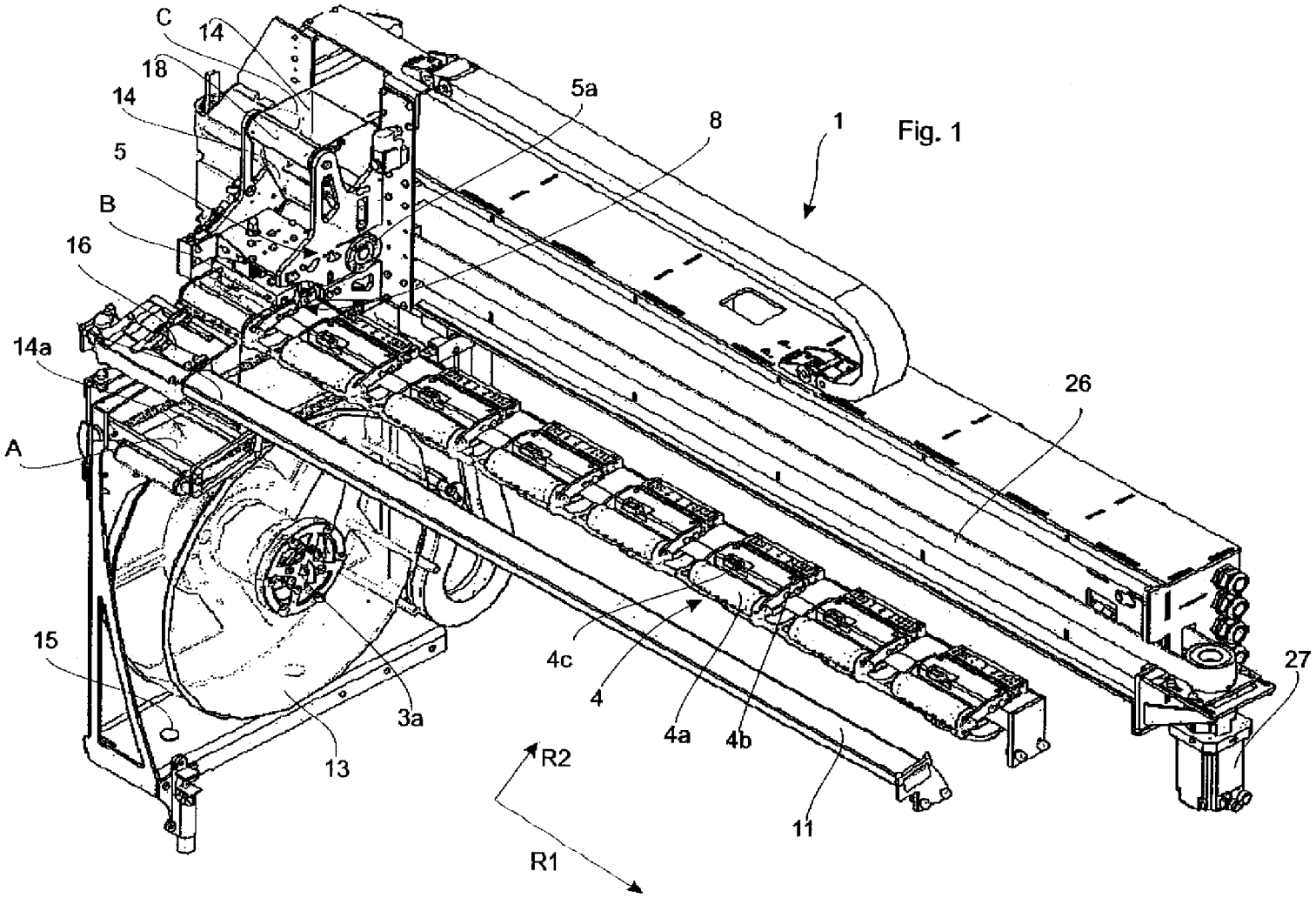
FIG. 1 shows a perspective view of a loading device according to the invention.

FIG. 1 shows a loading device 1 in a perspective view. This loading device 1 comprises a plurality of holding devices 15, although only one such holding device 15 is shown in FIG. 1. A carrier 3*a* is arranged on this holding device 15, and arranged in turn on this carrier is a label roll, onto which a label strip 14*a* is wound. During normal operation, this label strip 14*a* is unwound from the label roll and guided along the sections A, B and C via a plurality of deflection rollers. In the process, the carrier 3*a* is driven by a servo motor (explained in detail below). Also provided is a transport device 5, which here comprises a drawing roller 5*a*, for transporting the second label strip 14. The transport device 5 is arranged on a joining unit 8. The entire loading device 1 is arranged on a frame (not shown).

If a label roll 13 has run out, an end section of the label strip 14 that has just run out must be joined to a start section of a new strip of a further label roll 13. For this purpose, the loading device 1 comprises the joining unit 8. This joining unit 8 may be designed as a cutting/gluing unit. The joining unit 8 is moved here by a driven linear system 26 in the indicated movement direction R1. Here, reference 27 denotes a suitable linear drive for the joining unit 8 or a carriage of this joining unit 8. The loading device 1 also comprises a plurality of first fixing devices 4; more specifically, eight such fixing units 4 are present in FIG. 1. More specifically, each holding device 15 is assigned a specific fixing device 4. These fixing devices 4 comprise a deflection roller 4*a* and a suction strip 4*b* which at least temporarily fixes the label strip 14*a*. Finally, the fixing device 4 also comprises a detection device 4*c* which serves for detecting the respective roll start or the respective end section of the label strip. FIG. 1 shows the situation in which a second label strip is just being joined to a first label strip.

Reference 16 denotes a cutting device which serves for cutting the respective end sections. This cutting device 16 can be displaced along a bar 11 in the direction R1. Reference 18 denotes a deflection roller for the second label strip 14.

Figure 2:
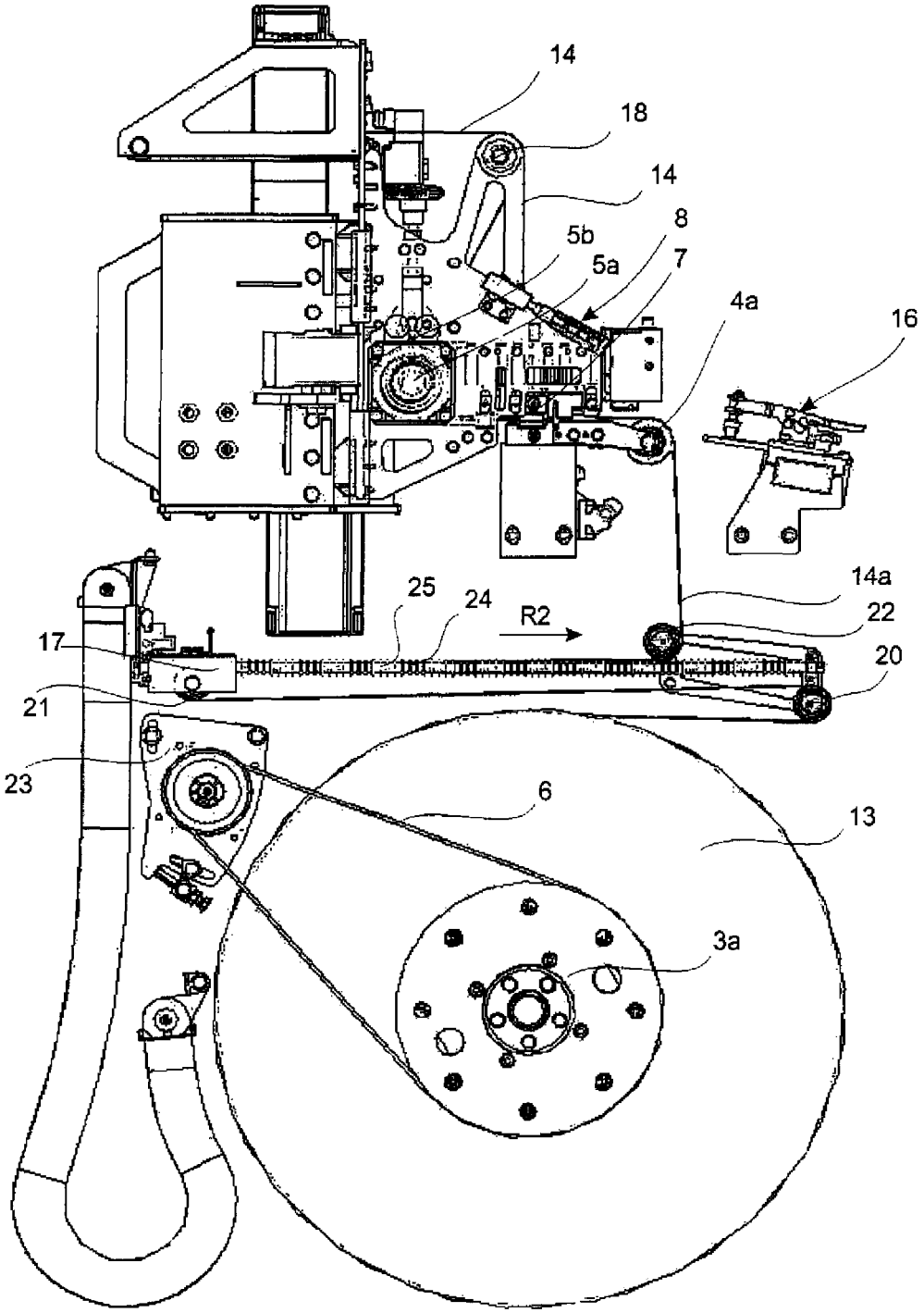
FIG. 2 shows a side view of the loading device of FIG. 1.

FIG. 2 shows a side view of the loading device 1 shown in FIG. 1, wherein here too only one carrier 3*a* is shown. This carrier 3*a* and the label roll 13 guided thereon are driven via a servo motor 23 by means of a belt 6. Alternatively, however, a direct drive could also be provided. The label strip 14*a* is guided over three deflection rollers 20, 21, 22, wherein these deflection rollers 20, 21, 22 form part of a buffer store. More specifically, the deflection roller 21 can move in translation in the direction R2 relative to the two deflection rollers 20 and 22. At the same time, the deflection roller 21 is pre-stressed relative to the deflection rollers 20 and 22 by a pre-stressing device such as a spring 24. Arranged on the deflection roller 21 is a detection device 17 for detecting the fullness state of the label roll 13. In the normal situation, a new, i.e. completely unused, label roll 13 is placed onto the carrier 3*a*. A completely full label roll 13 is associated with a predefined motor speed of the servo motor 23 and a corresponding transport speed of the transport device 5. If, therefore, a complete label roll 13 is inserted, the deflection roller 21 will not move in translation in the direction R2.

The situation is different if a label roll 13 which is not completely full is inserted. In this case, too, the servo motor 23 first rotates at a predefined speed associated with a completely full label roll 13. However, since a label roll which is not completely full has a smaller diameter, this means that the transport speed of the transport device 5 is higher than the transport speed which is brought about by the rotation of the servo motor 23 and at which the label roll 13 is unwound. As a result, the detection device 17 moves to the right in FIG. 2 counter to the spring force of the spring 24. The actual fullness state of the label roll 13 can be determined from the speed of this movement or the distance in the direction R2 which is covered in a certain time interval.

This distance measurement of the detection device 17 may be carried out for example optically using lasers and line markings on the rod 25 on which the spring 24 is arranged. However, use may also be made of distance sensors which determine the distance between the detection device 17 and a specific reference point. Furthermore, the fullness state thus determined is used to control the speed of the servo motor 23. If, for example, an only partially full label roll 13 has been inserted, the speed of the servo motor 23 will be increased accordingly.

Since the roll diameter of the label roll 13 will also decrease over time, it is also particularly advantageous to adapt the speed of the servo motor 23 to this circumstance and to allow the servo motor 23 to rotate more and more quickly as the unwinding operation progresses.

FIG. 2 shows the point in time at which a joining process is just taking place between the label strip 14*a* and the label strip 14. For this purpose, the loading device 1 has a second fixing device 7 which is arranged on the joining unit 8. This fixing device 7 may likewise be a suction strip which fixes the corresponding end section of the label strip 14. This second fixing device 7 is not shown in detail in FIG. 2.

It will be apparent to those skilled in the art that various modifications and variations can be made to the labeling system, loading device, and method for joining label strips of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. Labeling system comprising:

a labeling device for applying labels to objects; and a loading device upstream of the labeling device, the loading device supplying labels to the labeling device, the loading device comprising a transport device configured to transport a second label strip, at least two carriers for a first label strip wound onto label rolls, said carriers being arranged next to one another on holding devices, and a joining unit movable between the carriers in a first movement direction, the joining unit being configured to join a section of the first label strip to a section of the second label strip, wherein the transport device can be displaced together with the joining unit in the same direction, and move at the same time, relative to a frame to which both the transport device and the joining unit are attached.

2. Labeling system according to claim 1, wherein the transport device is configured to move the second label strip at least partially in a second movement direction relative to the joining unit, wherein the first movement direction and the second movement direction are substantially perpendicular to one another.

3. Labeling system according to claim 1, wherein each carrier is assigned a stationary first fixing device, the first fixing device being configured to at least temporarily hold an end section of the first label strips.

4. Labeling system according to claim 3, wherein the joining unit includes a second fixing device, the second fixing device being configured to at least temporarily hold an end section of the second label strips.

5. Labeling system according to claim 4, wherein at least one of the first fixing device and the second fixing device comprises a vacuum suction strip.

6. Labeling system according to claim 3, wherein the first fixing device is on the frame, which also bears the carriers and/or the holding devices thereof.

7. Labeling system according to claim 1, wherein each carrier is driven by a servo motor.

8. Labeling system according to claim 7, wherein each carrier is driven by a separate individual servo motor, the drive speed of the individual servo motors being controllable.

9. Labeling system according to claim 1, wherein at least one carrier is arranged on a displaceable holding device.

10. Labeling system according to claim 9, wherein the holding device is displaceable in the second movement direction.

11. Labeling system according to claim 1, further comprising at least one fullness measuring device, said fullness measuring device being configured to check a fullness state of at least one label roll.

12. Labeling system according to claim 1, further comprising a plurality of deflection rollers between the carriers and the joining device, wherein at least two deflection rollers can move in translation relative to one another.

13. Labeling system according to claim 12, wherein at least one deflection roller is pre-stressed with respect to the others.

14. Labeling system according to claim 1, further comprising a cutting device for cutting the label strips.

15. Labeling system according to claim 14, wherein the cutting device is displaceable.

16. Labeling system according to claim 1, further comprising a strip store downstream of the loading device, the strip store being configured to store labels that have already been unwound from the label roll but have not yet been supplied to the labeling device.

17. Labeling system according to claim 1, wherein the labeling device is designed to process endless label strips which are cut to the desired length only at the labeling device.

18. Labeling system according to claim 1, wherein the labeling device is configured to apply labels to containers.

19. Labeling system according to claim 1, wherein the loading device is a magazine in which a plurality of label rolls are arranged.

20. Labeling system according to claim 1, wherein the transport device forms part of the joining unit.

* * * * *